US009301607B1

(12) United States Patent
McLaurin

(10) Patent No.: US 9,301,607 B1
(45) Date of Patent: Apr. 5, 2016

(54) COMBINATION TOY CHEST AND PLAY STATION

(71) Applicant: Joyce McLaurin, Syracuse, NY (US)

(72) Inventor: Joyce McLaurin, Syracuse, NY (US)

( * ) Notice: Subject to any disclaimer, the term of this patent is extended or adjusted under 35 U.S.C. 154(b) by 0 days.

(21) Appl. No.: 14/618,514

(22) Filed: Feb. 10, 2015

Related U.S. Application Data

(60) Provisional application No. 61/942,692, filed on Feb. 21, 2014.

(51) Int. Cl.
*A63H 33/00* (2006.01)
*A47B 83/04* (2006.01)

(52) U.S. Cl.
CPC ..... *A47B 83/045* (2013.01); *A63H 33/00* (2013.01)

(58) Field of Classification Search
CPC .... A47B 83/045; A47B 77/10; A47B 46/005; B25H 3/06; F25D 25/02; E04B 2002/7483; G09F 19/22; E01F 9/065; F16G 15/06; E21F 17/185; F21W 2111/02; F21W 2131/305; F21W 2131/307; G01B 11/16; A61G 12/005; F21V 23/0485; A63H 33/00; A63H 3/52
See application file for complete search history.

(56) References Cited

U.S. PATENT DOCUMENTS

| | | | | | |
|---|---|---|---|---|---|
| 99,746 | A | * | 2/1870 | Bacon | 312/282 |
| 149,767 | A | * | 4/1874 | Loomis | 312/309 |
| 657,930 | A | * | 9/1900 | Feldkircher | 312/123 |
| 960,594 | A | * | 6/1910 | Snyder | 108/37 |
| 1,182,339 | A | * | 5/1916 | Bekesi | 297/142 |
| 1,448,788 | A | * | 3/1923 | Campbell | 312/291 |
| 1,478,371 | A | * | 12/1923 | Albrighton | 190/12 R |
| 1,590,674 | A | * | 6/1926 | Cummings | 312/298 |
| 1,655,516 | A | * | 1/1928 | Simpson | 312/314 |
| 1,731,325 | A | * | 10/1929 | Stevens | 312/290 |
| 1,949,404 | A | * | 3/1934 | Bailey | 312/235.3 |
| 1,949,405 | A | * | 3/1934 | Bailey | 108/37 |
| 2,046,398 | A | * | 7/1936 | McGowan | 297/147 |
| 2,122,969 | A | * | 7/1938 | Whitcomb | 108/9 |
| 2,156,776 | A | * | 5/1939 | Drover | 312/289 |
| 2,244,211 | A | * | 6/1941 | Nelson | 190/12 R |
| D140,702 | S | * | 3/1945 | Twente | D6/397 |
| D146,611 | S | | 4/1947 | Mellick | |
| 2,547,808 | A | * | 4/1951 | Burrage | 312/235.3 |
| 2,580,784 | A | * | 1/1952 | Hoppe | 312/228 |
| 2,665,963 | A | * | 1/1954 | Wallack | 312/235.3 |
| 3,031,782 | A | * | 5/1962 | Frye | 312/281 |
| 3,042,467 | A | * | 7/1962 | Germick | 312/235.8 |
| 3,880,485 | A | * | 4/1975 | Schmelzer | 312/282 |
| 4,071,747 | A | * | 1/1978 | Pantanella | 362/127 |
| 4,103,455 | A | | 8/1978 | Silvey | |
| 4,146,762 | A | * | 3/1979 | Peck et al. | 200/61.62 |
| 4,168,411 | A | * | 9/1979 | Peck | 200/61.62 |
| 4,436,353 | A | * | 3/1984 | Tucker | 312/241 |
| 4,515,359 | A | * | 5/1985 | Mariol | 446/481 |

(Continued)

FOREIGN PATENT DOCUMENTS

| | | | | |
|---|---|---|---|---|
| GB | 876003 | A * | 8/1961 | E05B 15/025 |

*Primary Examiner* — Michael Dennis
*Assistant Examiner* — Urszula M Cegielnik
(74) *Attorney, Agent, or Firm* — Robert C. Montgomery; Montgomery Patent & Design, LP.

(57) ABSTRACT

A combination toy chest and play station includes a toy chest defining an interior space, a lid hingedly connected to toy chest for enclosing the interior space, and a table hingedly connected to the toy chest. The table is pivotable about the toy chest between a vertical orientation and a horizontal orientation.

10 Claims, 6 Drawing Sheets

(56) References Cited

U.S. PATENT DOCUMENTS

| | | | | | |
|---|---|---|---|---|---|
| D282,032 | S | | 1/1986 | Lemmeyer | |
| 4,621,308 | A | * | 11/1986 | Holmberg et al. | 362/154 |
| 4,682,827 | A | | 7/1987 | Woodward | |
| 4,893,885 | A | * | 1/1990 | Borello | 312/249.9 |
| 4,993,782 | A | * | 2/1991 | Williams | 312/21 |
| 5,005,925 | A | * | 4/1991 | Diehl | 312/282 |
| 5,429,432 | A | * | 7/1995 | Johnson | 312/235.3 |
| 5,536,080 | A | * | 7/1996 | Madimenos et al. | 312/317.1 |
| 5,775,034 | A | * | 7/1998 | Logue | 52/36.1 |
| 5,803,562 | A | * | 9/1998 | Jacobs et al. | 312/283 |
| 7,451,709 | B2 | * | 11/2008 | Swartfager et al. | 108/14 |
| 7,766,435 | B2 | * | 8/2010 | Hsieh | 312/249.4 |
| 8,104,803 | B2 | * | 1/2012 | Horton | E05B 83/30 200/339 |
| 8,127,695 | B2 | * | 3/2012 | MacDonald et al. | 108/115 |
| 2002/0084175 | A1 | * | 7/2002 | Meagher et al. | 200/61.73 |
| 2005/0099102 | A1 | * | 5/2005 | Villarreal | 312/237 |
| 2005/0199625 | A1 | | 9/2005 | Salamone | |
| 2006/0060458 | A1 | * | 3/2006 | Meagher et al. | 200/61.73 |
| 2007/0080049 | A1 | * | 4/2007 | Dimig et al. | 200/61.73 |

* cited by examiner

COMBINATION TOY CHEST AND PLAY STATION

RELATED APPLICATIONS

The present invention is a continuation-in-part of, was first described in, and claims the benefit of U.S. Provisional Application No. 61/942,692, filed Feb. 21, 2014, the entire disclosures of which are incorporated herein by reference.

FIELD OF THE INVENTION

The present invention relates generally to furniture and, more particularly, to a combination furniture including a storage chest and a play station.

BACKGROUND OF THE INVENTION

Anyone who has or had young children realizes what a constant battle it is to keep their toys put away and neat when not in use. Various storage methods such as closets, shelving units, and toy boxes are commonly used, but most often the parent or care giver is the one that ends up using them. Even if the children are successfully taught to use such storage methods, these methods suffer from drawbacks.

First, most of these methods do not offer any means to keep the stored toys free from dirt and dust when they are not being used. Secondly, small toys in the bottom of the toy box seldom get played with. Third, most storage methods provide no means to store or use objects such as paper, pencils, coloring books, crayons, or the like. Finally, and perhaps most important, none of these storage methods are fun to use, thus constant nagging is necessary to encourage children to use them, and put away their toys on their own.

Accordingly, there exists a need for a means by which toys can be stored when not in use, without the disadvantages as described above.

SUMMARY OF THE INVENTION

The inventor has recognized the aforementioned inherent problems and lack in the art and observed that there is a need for a means to keep toys clean and organized, but is also fun to use, thus encouraging a child to use it. The development of the present invention, which will be described in greater detail herein, substantially departs from conventional solutions to fulfill this need.

In one embodiment, the disclosed combination toy chest and play station includes a toy chest defining an interior space, a lid hingedly connected to toy chest for enclosing the interior space, and a table hingedly connected to the toy chest. The table is pivotable about the toy chest between a vertical orientation and a horizontal orientation.

In another embodiment, the disclosed combination toy chest and play station includes a toy chest including a front side wall, a rear side wall, a right side wall, a left side wall, a floor and an open top. The toy chest defines an interior space. The combination toy chest and play station further includes a lid hingedly connected to the rear side wall for covering the open top and enclosing the interior space. The combination toy chest and play station further includes a rotary platform operatively connected to the floor. The combination toy chest and play station further includes a table hingedly connected to the rear side wall. The table is pivotable about the rear side wall between a vertical orientation and a horizontal orientation. The toy chest is rotatably relative to the rotary platform.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
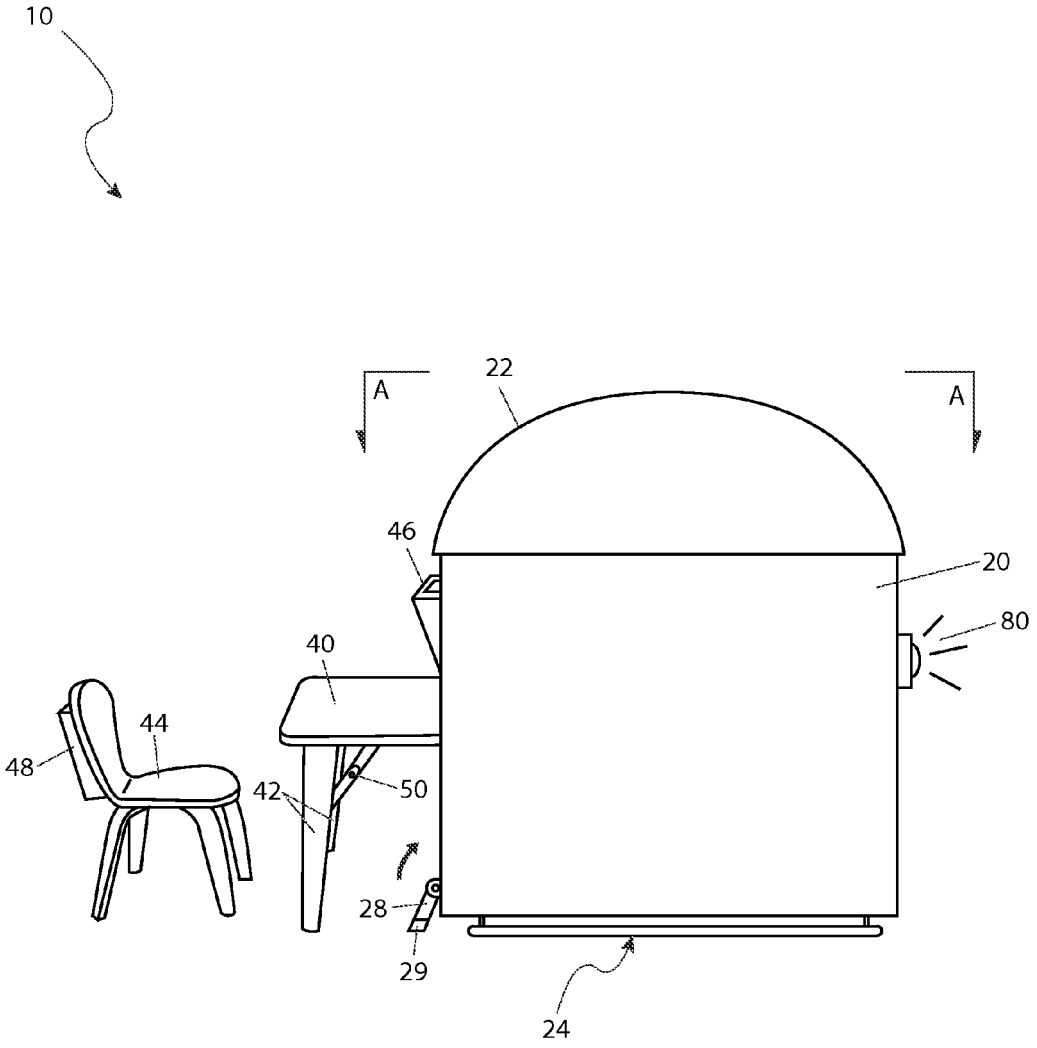
FIG. 1 is a side view of a combination toy chest and play station, according to one embodiment of the present invention.

10 combination toy chest and play station
20 toy chest
21*a* side wall
21*b* floor
22 lid
23*a* clasp
23*b* lid hinge
24 rotary platform assembly
25 interior space
28 anchoring device
29 foot
40 table
41 table recess
42 table leg
43 rod hinge
44 chair
46 first storage compartment
47*a* storage compartment recess
47*b* storage compartment hinge
48 second storage compartment
50 leg brace
51 leg bracket
60 platform
62 annular protrusion
63 annular cavity
64 ball bearing
66 ball bearing groove
68 wear plate

70 strut assembly
71*a* first mounting joint
71*b* second mounting joint
72 fastener
80 lamp/actuator assembly
81 latch cavity
82 lens
83 housing
84*a* switch
84*b* lamp
85 battery
90 actuator rod
92 latch arm
93*a* pivot pin
93*b* anchor pin
94 latch hook
96 return spring

DETAILED DESCRIPTION OF THE PREFERRED EMBODIMENT

In accordance with the invention, the best mode is presented in terms of a one or more of the disclosed embodiments, herein depicted within FIGS. 1 through 5. However, the disclosure is not limited to a single described embodiment and a person skilled in the art will appreciate that many other embodiments are possible without deviating from the basic concept of the disclosure and that any such work around will also fall under its scope.

Further, those skilled in the art will recognize that other styles and configurations can be incorporated into the teachings of the present disclosure, and that the example configurations shown and described herein are for the purpose of clarity and disclosure and not by way of limitation.

As used herein, the singular terms "a", "an", and "the" do not denote a limitation of quantity, but rather denote the presence of at least one (1), as well as a plurality of, the referenced items, unless the context clearly indicates otherwise.

As used herein, the terms "first", "second", "third", etc. are used as labels to describe various elements, features, and/or components, and are not intended to impose ordinal, positional, or hierarchical requirements on the referenced items, unless other indicated. For example, such terms may be used to distinguish one (1) element from another element.

As used herein, relative terms such as "front", "rear", "left", "right", "top", "bottom", "below", "above", "upper", "lower", "horizontal", or "vertical" are used to describe a relationship of one (1) element, feature and/or region to another element, feature and/or region as illustrated in the figures.

Referring generally to FIGS. 1-5, disclosing example embodiments of the disclosed combination toy chest and play station (herein described as the "apparatus") 10, where like reference numerals represent similar or like parts. The apparatus 10 includes a toy storage receptacle and activity center for children, which includes a deployable table 40 and a chair 44. The apparatus 10 includes a spring-loaded lid 22 to store and keep toys clean, while providing a neat appearance.

Figure 2:
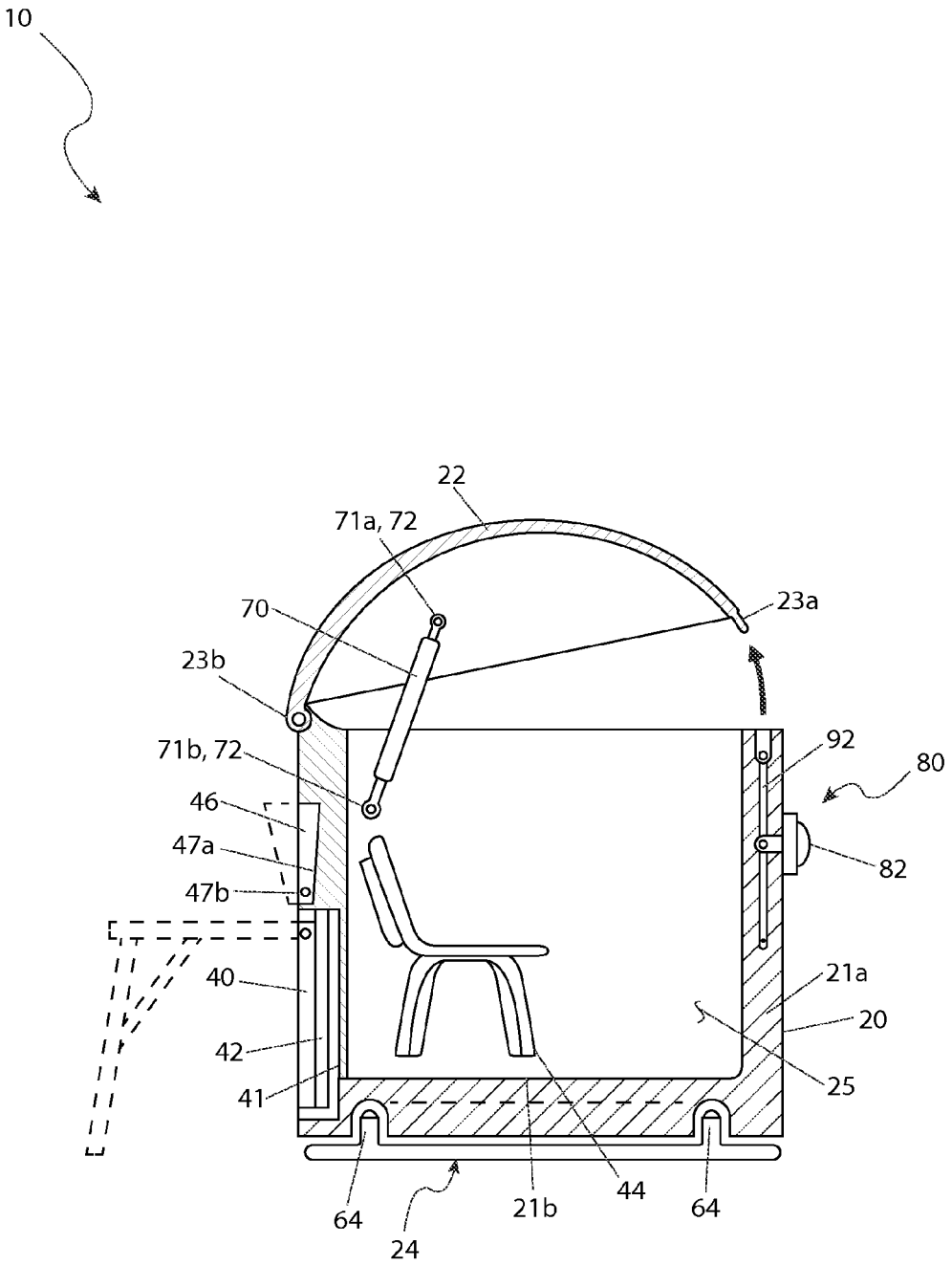
FIG. 2 is a sectional view of the combination toy chest and play station taken along section line A-A of FIG. 1, according to one embodiment of the present invention.

Referring to FIGS. 1 and 2, one embodiment of the disclosed apparatus 10 includes a primarily cylindrical or polyhedron-shaped plastic toy chest 20. The toy chest 20 includes side walls 21*a*. For example, the side walls 21*a* include a first (e.g., front) side wall, a second (e.g., rear) side wall, a third (e.g., left) side wall, and a fourth (e.g., right) side wall. The toy chest 20 includes a hollow interior space 25 (FIG. 2) defined by the side walls 21*a* capable of containing a plurality of toys and other items. The toy chest 20 is envisioned to be made of a hollow or solid plastic construction and be approximately three (3) feet in both width and height dimensions.

The toy chest 20 includes a rotary platform assembly 24 to allow rotation of the toy chest 20 to access all sides regardless of placement within a room.

The toy chest 20 includes an anchoring device 28 (FIG. 1) mounted along a bottom edge portion of a side wall 21*a*. The anchoring device 28 includes a folding member that may be deployed downwardly against a subjacent floor surface, as desired, to stabilize and arrest the rotary motion of the toy chest 20 about the rotary platform assembly 24. The anchoring device 28 is envisioned to include a foot 29. The foot 29 includes a rubber tip, for example, being similar to a door stop.

The top of the toy chest 20 is open. The spring-loaded lid 22 is hingedly connected to the toy chest 20 and swings upwardly (e.g., in the direction of directional arrow in FIG. 2) when released via an upward force applied by at least one spring-loaded strut 70 attached to lid 22 and side wall 21*a*. As an example construction, the spring-loaded strut 70 is attached to lid 22 and side wall 21*a* via respective integral first mounting eyelet 71*a* and second mounting eyelet 71*b* (FIG. 2). The first mounting eyelet 71*a* and second mounting eyelet 71*b* (identified collectively herein as eyelets 71*a*, 71*b*) are integral to opposing ends of the strut 70. As an example construction, the eyelets 71*a*, 71*b* are rotatingly connected to the lid 22 and side wall 21*a* using corresponding fasteners 72 such as shoulder bolts, screws, or the like. The strut 70 is envisioned to be a commercially-available linear rod-and-tube device (e.g., similar to those used upon automotive lift gates) and gas-charged and/or containing an internal compression spring.

The lid 22 includes an integral clasp 23*a* (FIG. 2) that protrudes downwardly from a forward perimeter edge. The lid 22 includes a lid hinge 23*b* along an opposite rearward perimeter edge. The lid 22 may be released to swing upwardly, via the strut 70, by pressing a lens 82 of a lamp/actuator assembly 80 located subjacent (e.g., near and below) to the clasp 23*a*. As one (1) example construction, and as illustrated in FIGS. 1 and 2, the lid 22 includes a dome-shaped; however, the lid 22 may include other molded forms and/or shapes including, but not limited to, animal shapes, geometric shapes, alphanumeric shapes, and the like.

Figure 3A:
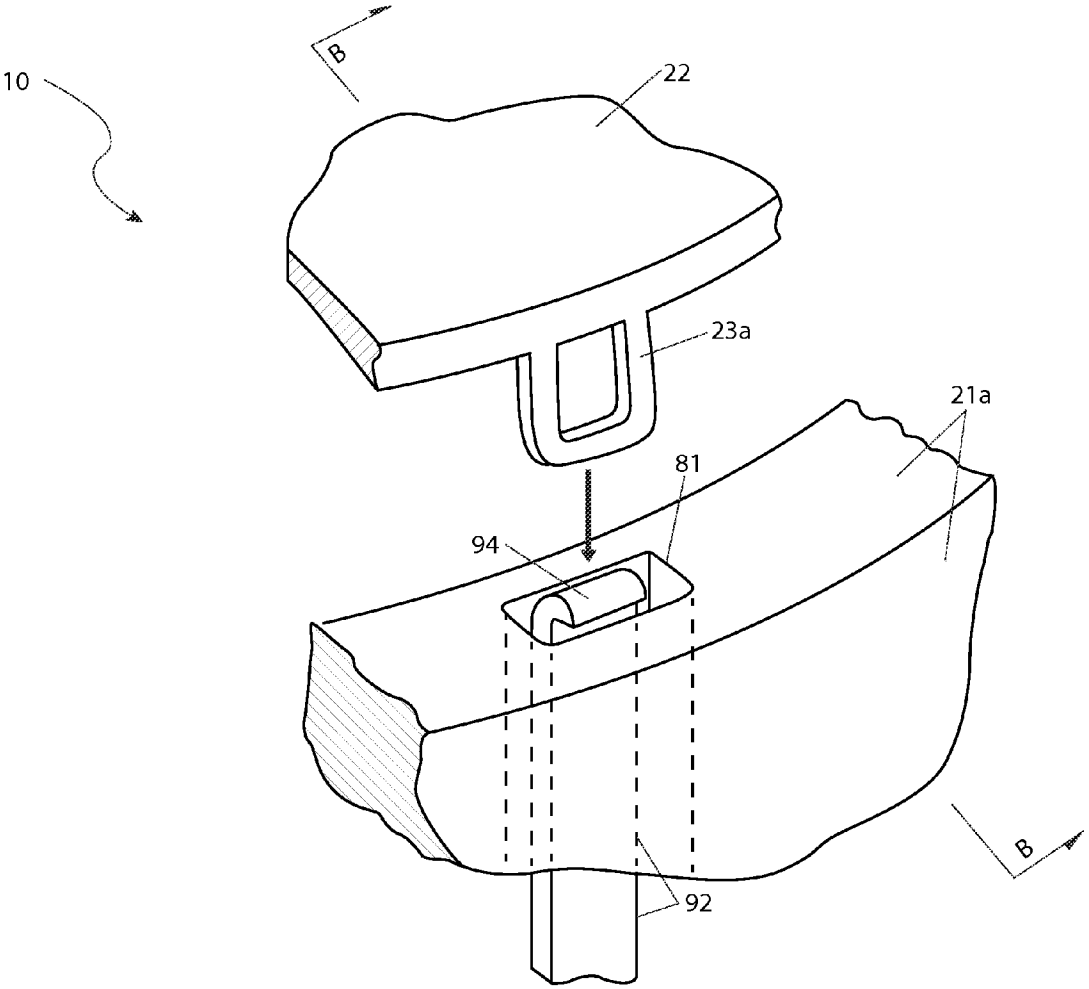
FIG. 3*a* is a perspective view of a latch of the combination toy chest and play station, according to one embodiment of the present invention.
Figure 3B:
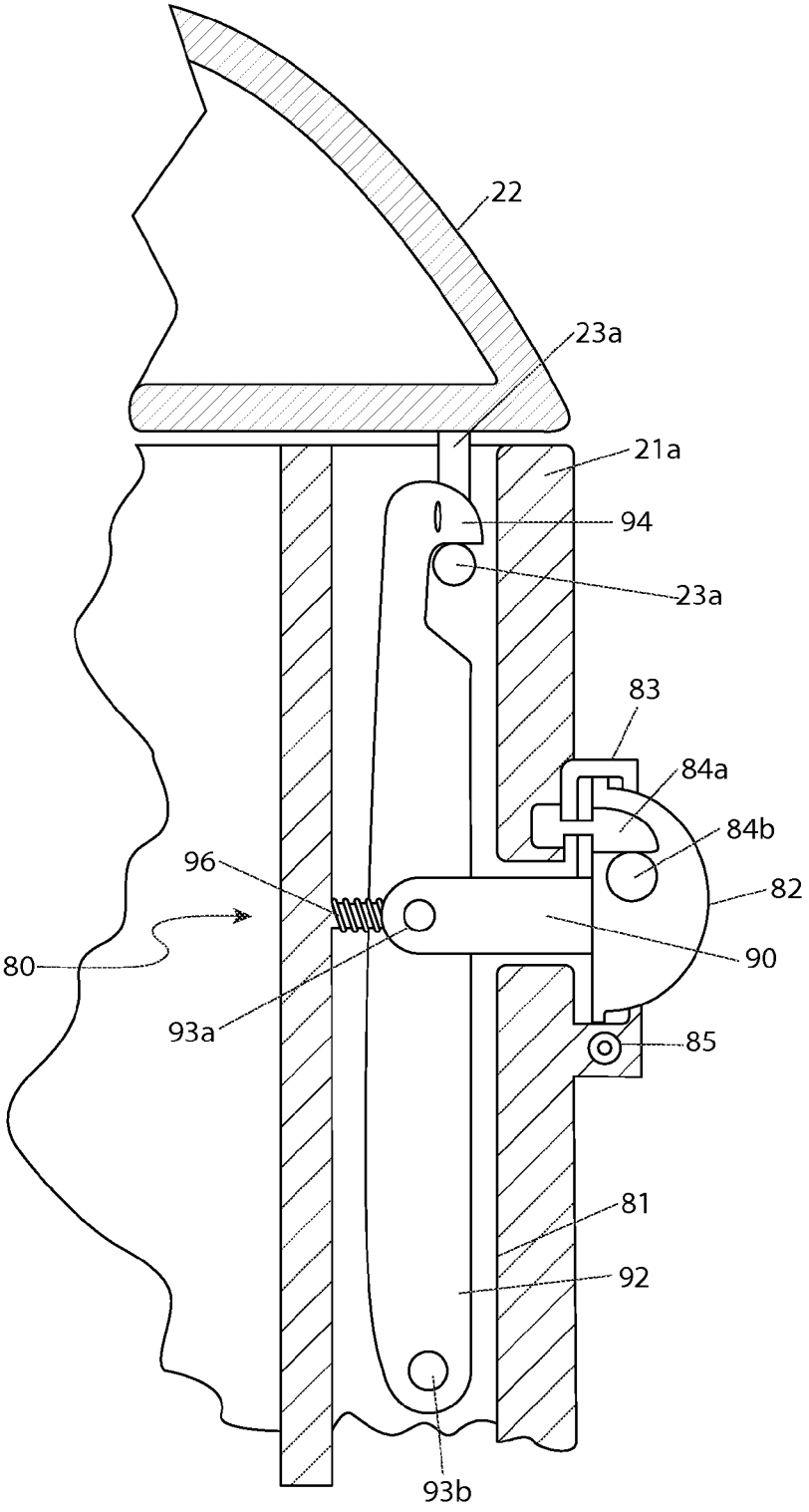
FIG. 3*b* is a sectional view of latch and lamp/actuator assembly of the combination toy chest and play station taken along section line B-B of FIG. 3*a*, according to one embodiment of the present invention.
Figure 5:
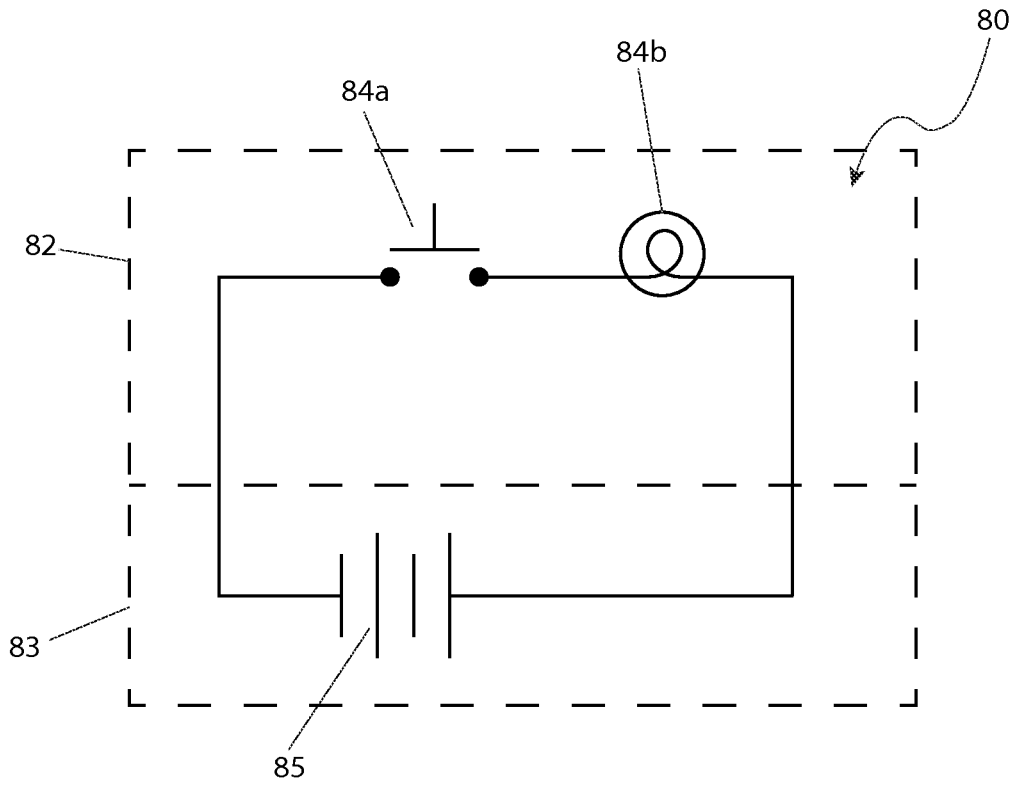

The lamp/actuator assembly 80 also acts as a light fixture to provide local illumination via internal switch 84*a* and lamp 84*b* (FIGS. 3*b* and 5).

At least one (1) side wall 21*a* of the toy chest 20 provides for flush-mounted storage of the fold-down table 40 and at least one toy chest (e.g., first) storage compartment 46 via respective table recess 41 and storage compartment recess 47*a* (FIG. 2).

The first storage compartment 46 includes a rectangular box-like structure that pivots outwardly about a lower edge from the correspondingly shaped storage compartment recess 47*a*. The first storage compartment 46 is rotatingly attached to the side wall 21*a* via an axial storage compartment hinge 47*b*. The first storage compartment 46 provides a means for holding and storing small objects such as small toys, crayons, coloring books, and the like.

Figure 4:
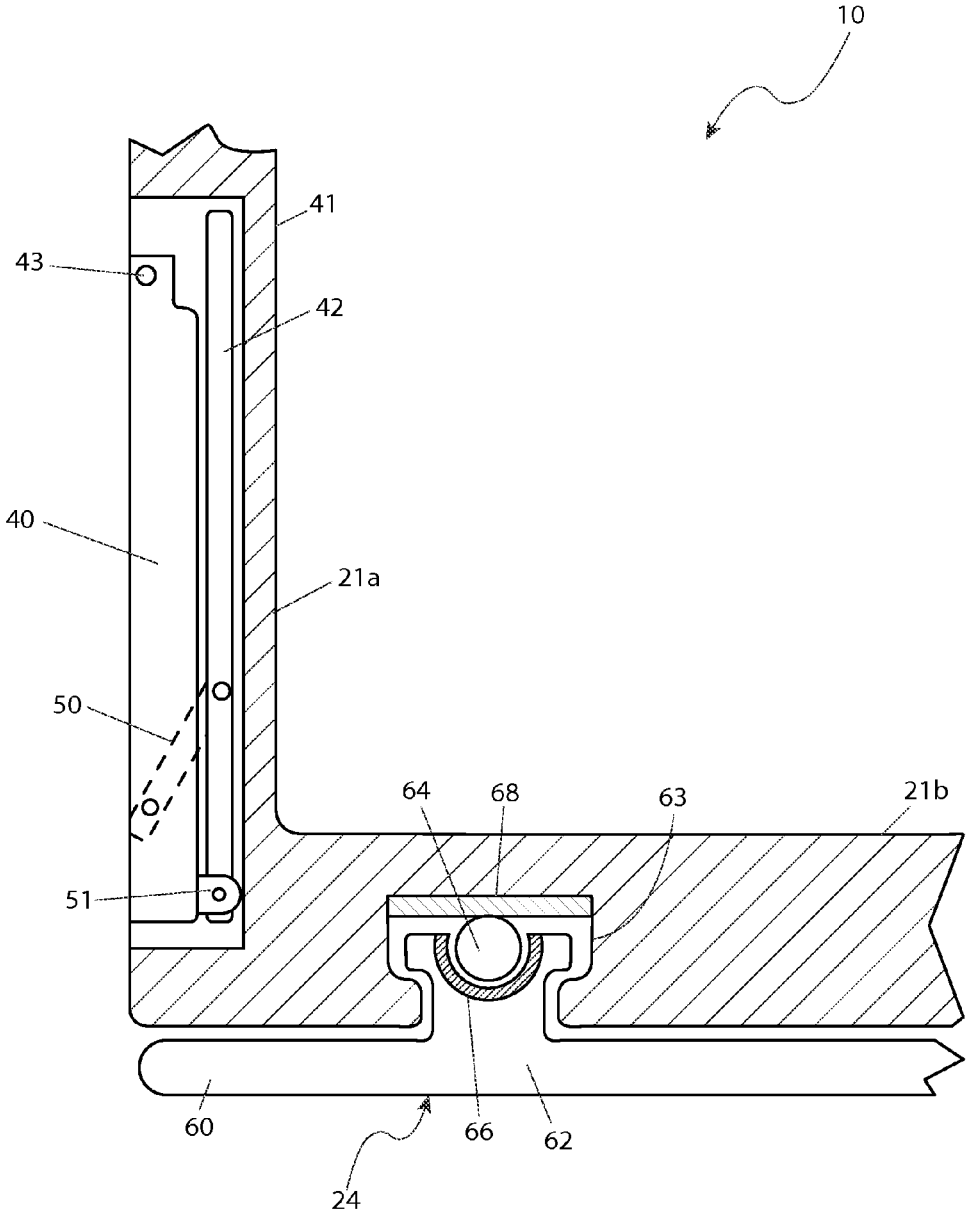
FIG. 4 is a sectional view of table recess and rotary platform of the combination toy chest and play station, according to one embodiment of the present invention; and, FIG. 5 is an electrical block diagram of the lamp/actuator assembly of the combination toy chest and play station, according to one embodiment of the present invention.

The fold down table 40 folds out from a flush-mounted position and includes a pair of pivotingly connected supporting legs 42 that fold out and lock in place via respective folding leg braces 50 (FIG. 4).

The apparatus 10 also provides a separate child's chair 44 preferably having a unitary plastic molded form, or equivalent construction, envisioned to have a padded upper surface and a chair (e.g., second) storage compartment 48 integrally-molded into a seatback. The second storage compartment 48 hinges upward in a similar fashion as the previously described first storage compartment 46.

The apparatus 10 allows a child to use the table 40 and chair 44 to perform various craft activities, coloring, or the like. When finished with play, the table legs 42 may be folded up and the table 44 folded downwardly into the table recess 41. The table 44 is envisioned to be retained within the table recess 41 via a friction fit or integrally-molded interfering features. The toys and accessories are returned to the first 46 and second 48 storage compartments, and the first storage compartment 46 closed for a neat and organized appearance. It is envisioned that the chair 44 may remain outside the toy chest 20 or be stored within, as desired.

The toy chest 20, lid 22, and chair 44 are envisioned to be made of a hollow or solid plastic construction utilizing common plastic molding processes such as blow molding, thermoforming, injection-molding, or equivalent methods, and envisioned to be introduced in various attractive colors and patterns.

Referring to FIG. 3*a*, the strut 70 provides a force to motion the lid 22 upwardly upon being released from the closed position (FIG. 2). The lid 22 is retained in a closed position via engagement of a "U"-shaped clasp 23*a* of the lid 22 with a correspondingly positioned latch hook 94 of the side wall 21*a*.

Referring to FIG. 3*b*, releasing the lid 22 is accomplished by pressing upon the dome-shaped lens 82 of the lamp/actuator assembly 80. The lens 82 is located along an outer surface of the side wall 21*a*, which when pressed upon by a user, disengages the latch hook 94 from the clasp 23*a*.

The lamp/actuator assembly 80 includes an integral actuator rod 90 that protrudes horizontally inward and is in mechanical communication with a latch arm 92 at an intermediate location via a pivot pin 93*a*. As one (1) example construction, the latch arm 92 is contained discreetly within the side wall 21*a* via a latch cavity 81 that extends vertically within the side wall 21*a*. The latch arm 92 includes the latch hook 94 at an upper end and is pivotingly attached at a lower end via an anchor pin 93*b*. As the actuator rod 90 is motioned inwardly in response to pushing on the lens 82, the pivot pin 93*a* acts upon and motions the latch arm 92 rearwardly, causing the latch hook 94 to disengage from the clasp 23*a*. The latch arm 92 is reset via a return spring 96 that motions the latch arm 92 forwardly upon release of the lens 82.

The lamp/actuator assembly 80 functions as a manually activated illumination means. The lamp/actuator assembly 80 includes a translucent plastic lens 82 that is slidingly contained within a housing 83, which further contains a switch 84*a*, a lamp 84*b*, and a battery 85. The lens 82 is in mechanical communication with the switch 84*a*, which completes an electrical circuit to provide power from the battery 85 to the lamp 84*b*. The lamp 84*b* is located within the lens 82. When pressed, the lamp 84*b* causes the translucent lens 82 to glow and provide local illumination.

Referring to FIG. 4, the apparatus 10 includes the table recess 41, for example, along the rear side wall 21*a*, which provides discreet "flush" storage of the table 40 when not in use. The table recess 41 includes a rod hinge 43 that passes through one (1) end of the table 40 and extends laterally across the table recess 41. The rod hinge 43 is anchored in opposing inner side surfaces of the side wall 21*a* defining the table recess 41. The table 40 includes the pair of folding legs 42 that are pivotingly attached to leg brackets 51 of the table 40 and lockable in the deployed position via respective folding leg braces 50, for example, in a manner similar to that of a card table.

Referring to FIGS. 2 and 4, the apparatus 10 provides a means to rotate the toy chest 20 via the rotary platform assembly 24. The rotary platform assembly 24 includes a platform 60 located below the floor 21*b* of the toy chest 20. As one (1) example construction, the platform 60 has a similar perimeter size and shape as the floor 21*b*. The platform 60 includes an integrally-molded annular protrusion 62 (FIG. 4) having a "T"-shaped cross-section. The annular protrusion 62 includes an integral circular metal ball bearing groove 66 along a top surface having a cup-shaped cross-section so as to retain a plurality of ball bearings 64 in a captivating manner.

Referring to FIG. 4, the annular protrusion 62 extends upwardly in an interlocking manner into a correspondingly shaped annular cavity 63*a* formed within the floor 21*b* of the toy chest 20. The annular cavity 63*a* includes a metal wear plate 68 along a top inner surface against which the ball bearings 64 within the annular protrusion 62 bear the weight of the toy chest 20. The ball bearings 64 roll freely between the ball bearing groove 66 and the wear plate 68 to provide smooth rotary motioning of the toy chest 20 relative to the platform 60, thereby allowing access to all sides of the toy chest 20, regardless of placement in a room.

Referring to FIG. 5, the lamp switch 84*a* provides current from a rechargeable or disposable battery 85 to the lamp 84*b*. The switch 84*a* is preferably an alternating on-off device and the lamp 84*b* is preferably a light-emitting-diode (LED) or equivalent current illumination technology.

Those skilled in the art will recognize that other styles and configurations of the disclosed apparatus 10 can be easily incorporated into the teachings of the present disclosure, and only particular example embodiments and configurations have been shown and described for purposes of clarity and disclosure and not by way of limitation of scope.

The example embodiment of the disclosed apparatus 10 can be utilized by the user in a simple and effortless manner with little or no training. After initial purchase or acquisition of the apparatus 10, it would be installed and utilized as indicated in FIGS. 1 and 2.

One (1) embodiment of the disclosed method for installing and preparing the apparatus 10 for use may be achieved by performing the following steps: 1). procuring a model of the apparatus 10 having a desired size, color, and shape; placing the apparatus 10 at a desired location; 2). rotating the toy chest 20 upon the rotary platform assembly 24 until obtaining a desired orientation; 3). deploying the anchoring device 28 downwardly until the foot 29 contacts a floor surface to secure the position of the apparatus 10; 4). loading small objects such as small toys, crayons, coloring books, and the like into the first storage compartment 46 by pivoting the first storage compartment 46 outwardly from the storage compartment recess 47*a*, and additional items into the second storage compartment 48 located upon a seatback of the chair 44, as desired; 5). raising the lid 22 to load toys and other items into the toy chest 20 by pressing upon the lens 82 of the lamp/actuator assembly 80 to release the clasp 23*a* from the latch hook 94 allowing the lid 22 to automatically raise via the force of the strut 70; 6). loading toys and other items into the toy chest 20 for subsequent playing; 7). closing the lid 22 by pulling downward until engaging the clasp 23*a* and latch hook 94; and, 8). activating the illuminating function of the lamp/actuator assembly 80, if desired, by pressing upon the lens 82.

One (1) embodiment of the disclosed method for utilizing the table 40 of the apparatus 10 for various craft activities may be achieved by performing the following steps: 1). deploying the table 40 by lifting upwardly upon a bottom edge of the table 40 until horizontal; 2). deploying the legs 42 by rotating downwardly and locking the legs 42 in position using the leg braces 50; 3). accessing small objects such as small toys, crayons, coloring books, and the like within the first storage compartment 46 by pivoting the first storage compartment 46 outwardly; 4). accessing additional items for use within the second storage compartment 48 of the chair 44 as desired; 5). positioning the child onto the chair 44 with respect to the table 40; and, 6). allowing the child to occupy the seat 44 and utilize the table 40 to enjoy various craft activities.

One (1) embodiment of the disclosed method for accessing the contents of the interior space 25 of the toy chest 20 may be achieved by performing the following steps: 1). raising the lid 22 by pressing upon the lens 82 of the lamp/actuator assembly 80 to automatically raise the lid 22; 2). accessing and removing wanted toys and other items within the toy chest 20 for playing; and, 3). closing the lid 22 to keep the contents clean by pulling downward until engaging the clasp 23*a* and latch hook 94.

The foregoing descriptions of example embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A combination toy chest and play station comprising:

a toy chest comprising a front side wall, a rear side wall, a right side wall, a left side wall, a floor and an open top, said toy chest defining an interior space, wherein said front side wall comprises an internal latch cavity and a latch arm disposed within said latch cavity, said latch arm comprises an upper end comprising a latch hook and a lower end pivotally connected to said front side wall;

a lid hingedly connected to said rear side wall for covering said open top and enclosing said interior space, wherein said lid comprises a U-shaped clasp protruding downwardly from a front perimeter edge, and wherein said claps is received by said latch cavity and releasably engages said latch hook to retain said lid in a closed position;

a spring-loaded strut interconnected between said rear side wall and said lid, wherein said spring-loaded strut biases said lid in an open position;

a rotary platform operatively connected to said floor; and, a table hingedly connected to said rear side wall;

wherein said table is pivotable about said rear side wall between a vertical orientation and a horizontal orientation; and, wherein said toy chest is rotatably relative to said rotary platform.

2. The combination toy chest and play station of claim 1, further comprising an actuator assembly, said actuator assembly comprising:

a housing connected to said front side wall;

a push-button lens movably connected within said housing;

an actuator rod extending from said lens into said latch cavity and pivotally connected to said latch arm; and, a return spring operatively connected to said actuator rod for biasing said lens to an outward position relative to said housing;

wherein actuation of said lens to an inward position relative to said housing pivots said latch arm and disengages said latch hook from said clasp.

3. The combination toy chest and play station of claim 2, wherein said actuator assembly further comprises a lamp assembly, said lamp assembly comprising:

a lamp housed within said lens;

a battery disposed within said housing; and, a switch in mechanical communication with said lens and electrical communication between said battery and said lamp;

wherein actuation of said lens to said inward position relative to said housing actuates said switch for energizing said lamp.

4. The combination toy chest and play station of claim 1, wherein said rotary platform comprises:

a platform located below said floor; and, an annular protrusion extending upwardly from said platform;

wherein said floor comprises an annular cavity; and, wherein said annular protrusion is mateably engaged within said annular cavity.

5. The combination toy chest and play station of claim 4, wherein:

said annular protrusion comprises an upper end comprising a T-shaped cross-sectional shape and a lower end;

said annular cavity comprises a T-shaped cross-sectional shape sized to slidingly receive said upper end of said annular protrusion; and, said annular cavity rides along said annular protrusion when said toy chest rotates relative to said platform.

6. The combination toy chest and play station of claim 5, wherein:

said annular protrusion comprises a ball bearing groove disposed in said upper end and ball bearings disposed within said ball bearing groove;

said annular cavity comprises a wear plate connected within said annular cavity and in contact with said ball bearings; and, said wear plate rides along said ball bearings when said toy chest rotates relative to said platform.

7. The combination toy chest and play station of claim 1, further comprising a storage compartment pivotally connected to said rear side wall between a vertical orientation and a non-vertical orientation.

8. The combination toy chest and play station of claim 7, wherein said rear side wall comprises a storage compartment recess configured to receive said storage compartment when in said vertical orientation.

9. The combination toy chest and play station of claim 1, wherein said rear side wall comprises a table recess configured to receive said table when in said vertical orientation.

10. The combination toy chest and play station of claim 1, further comprising an anchoring device pivotally connected to said rear side wall for preventing rotation of said toy chest relative to said rotary platform.

* * * * *